United States Patent [19]

Oster

[11] 4,104,947

[45] Aug. 8, 1978

[54] CAPO

[76] Inventor: Doran M. Oster, 1802 NE. 8th St., Gainesville, Fla. 32601

[21] Appl. No.: 764,264

[22] Filed: Jan. 31, 1977

[51] Int. Cl.[2] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 608,278 | 8/1898 | Benson | 84/318 |
| 3,647,930 | 3/1972 | Wowries | 84/318 |

FOREIGN PATENT DOCUMENTS

| | | | |
|---|---|---|---|
| 1,048,545 | 11/1966 | United Kingdom | 84/318 |

*Primary Examiner*—Lawrence R. Franklin
*Attorney, Agent, or Firm*—Dowell & Dowell

[57] ABSTRACT

An apparatus which clampingly engages the neck and the strings and fingerboard of a stringed instrument for selectively adjusting the pitch of the strings. The apparatus includes positioning guides for aligning the apparatus with respect to the frets which are disposed along the fingerboard and a pair of relatively thin, resilient string-engaging members which reduce undesirable string vibration and maintain proper string contact with the frets.

11 Claims, 6 Drawing Figures

CAPO

BACKGROUND OF THE INVENTION

1. Field of the Invention

This invention relates generally to an apparatus for selectively adjusting the pitch of the strings of a stringed instrument having a fingerboard with a plurality of frets disposed thereon and particularly to a capo which is alignable with respect to the frets and has independently mounted string damping and clamping members.

2. Description of the Prior Art

Capos, that is, devices which are placed about the neck of stringed instruments and cause a string or strings of the instrument to engage one of the frets of the fingerboard to thereby shorten the effective vibrating length of the string and alter the pitch thereof, have long been used by both novice and professional performers. There are many types and styles of capos available which are appropriate for use with guitars, banjos and other similar stringed instruments.

Many conventional capos include a clamping member which engages the back of the neck and a bar or plate-like member which extends across the strings and is brought into engagement therewith by a screw, elastic, or spring means which draws the bar toward the clamping member and causes the strings to engage a fret. In order to reduce undesirable vibrations of the strings against the bar, the bar or plate is usually wrapped in a resilient vibrational dampening material such as plastic or rubber.

The capo is frequently used by the novice, who is not skilled at playing a full range of chords, or who is not capable of transposing from one key to another. By advancing the capo from fret to fret and progressing from the head toward the sound body of the instrument, the pitch of each string may be advanced in ordered increments. Then, by utilizing the same basic chord form at each step, the beginner may play music in varying keys dependent upon the placement of the capo. The performer is likewise able to vary the basic pitch of the instrument by selectively shortening the effective vibrating length of the strings and thereby achieve a variety of sound variations.

However, there are a number of basic problems associated with the use of conventional capos. Often, capos are awkward to handle and manipulate and, therefore, they are neither easily mounted on the instrument nor easily adjusted along the neck as may sometimes be desirable. Frequently the player's full attention must be given to insuring that the capo is properly aligned generally normal to the strings to insure both that there are no sound variations and that the strings are appropriately aligned and damped as they pass over the engaged fret. Not only does this positioning of the capo take time, but frequently such changes in the capo's placement must be made while performing and thus any distraction caused by the positioning of the capo is undesirable. Also, if the capo should be excessively spaced from the fret or be angled relative thereto, an irritating vibration of the string against the fret or pitch variation may result. And conversely, if the capo is placed forwardly of the fret, the string will be damped and the sound obtained thereby muted.

Normally a capo is positioned between two frets and enough pressure is applied to the bar to cause the strings to engage such frets. However, since the strings are of different diameters, the bar engages the larger strings first and sequentially engages the smaller strings. This causes unequal pressure to be applied to the strings which, in turn, causes the strings to be out of pitch with themselves due to unequal stretching.

Also it frequently becomes necessary to tune the strings with the capo in place. Many capos have a bar-like member which is wrapped or coated with a relatively wide pad of resilient material. Often it is difficult to tune a string which is being gripped by the wide capo pad due to the frictional forces between the string and the resilient material of the capo. Also since the capo extends across all the strings, as one is adjusted, the frictional engagement between the moving string and the wide capo pad may tend to cause the capo to shift slightly in relationship with the other strings and thereby cause the other strings to go slightly out of tune. Therefore, in a manner, each of the strings is connected to the other strings via the wide bar-like member and pad and thus possibly affected by the adjustment to any of the other strings.

Another style of capo currently available includes a resilient pad formed as a sleeve with several outwardly extending ridges for engaging the strings. However, the pad is formed as a single unit which is slidably fitted about the bar which extends over the strings. Therefore, although the outwardly extending ridges may reduce the area of frictional contact, because elements of the pad are integrally formed and only slidably fitted about the capo bar, a deflection at a point along one of the pad ridges may be transmitted throughout the pad. Accordingly a shifting or rotating of the pad relative to the bar is possible.

Other examples of the prior art include patents Ser. No. 468,193 to Dahlman et al; Ser. No. 620,560 to Averitt; Ser. No. 692,751 to Winchell; U.S. Pat. No. 2,604,805 to Haffner; U.S. Pat. No. 3,185,012 to Dunlop; U.S. Pat. No. 3,205,751 to Lowe; U.S. Pat. No. 3,329,055 to Milliken; U.S. Pat. No. 3,680,427 to Valentino; and U.S. Pat. No. 3,823,247 to Bauerfeind.

SUMMARY OF THE INVENTION

This invention is embodied in a capo for use with a stringed instrument having a neck and fingerboard with a plurality of frets thereon such as a guitar, ukulele, banjo, or the like. The capo includes a conventional clamping member which moves a string clamping bar into engagement with the strings of the instrument and causes such strings to engage one of the frets. A pair of resilient generally narrow string engaging pads are independently mounted and retained in generally parallel spaced relationship along the string clamping bar. The pads extend across the full width of the fingerboard and are slightly yieldable along a line defined by the length of the strings. The first string engaging pad is positioned adjacent to a selected fret by means of a pair of adjustable guide members which are slidable along the fingerbord and the lower portions of such members are disposed between the strings. The other of the string engaging pads is spaced rearwardly of the first pad toward the head of the instrument to dampen the non-used string sections.

It is an object of this invention to provide a capo which is easily and accurately positioned relative to a fret by use of a fret engaging guide member.

It is another object of the invention to provide a capo having a first narrow resilient string engaging member to securely clamp the strings against a selected fret in such a manner that any adjustment in the tuning of one string will not adversely affect the tuning of the other strings.

It is another object of this invention to provide a capo having a second resilient string engaging pad spaced from the first string engaging pad to thereby damp the possible vibration of the non-playing portion of the strings between the capo and the head of the instrument.

It is another object of this invention to provide a capo having relatively adjustable fret aligning members which may be selectively located in a non-interfering position between the strings of the instrument.

It is a further object of this invention to provide a capo having resilient string engaging pads of such a shore hardness that they will substantially encompass the upper half of the strings so as to thereby reduce undesirable vibrations and yet be slightly yieldable along the length of the strings without transmitting such a deflection to portions of the pads which are in engagement with the other strings.

DESCRIPTION OF THE PREFERRED EMBODIMENT

Figure 1:
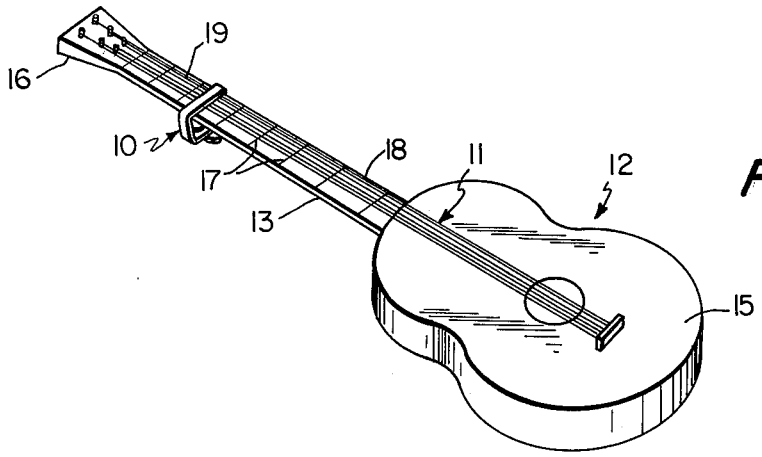
FIG. 1 is a perspective view of the invention in use on a stringed instrument.

With continued reference to the drawing, a capo 10 is illustrated in FIG. 1 as it would be used to adjust the pitch of the strings 11 of a guitar 12. The guitar, or other stringed instrument, includes a neck 13 along which is disposed a fingerboard 14. The neck is attached at one end to a sound body 15 and is provided with a head 16 at the other end. A plurality of frets 17 are situated in spaced generally parallel relationship along the fingerboard. The spacings of the frets are at predetermined distances so that as the effective playing length 18 of a string is progressively shortened or lengthened by forcing the string into engagement with the various frets, the pitch is varied in steps synonymous with increments of a musical scale.

It should be noted that when the effective playing length of a string is varied from its normal or full length by depressing such string against a fret, a non-playing or muted portion of the string 19 is created between such fret and the head of the instrument.

Figure 2:
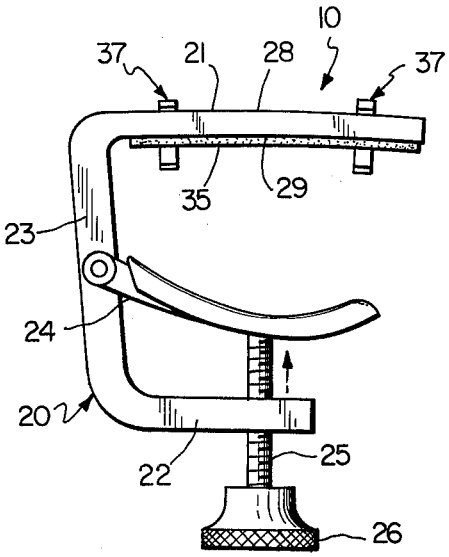
FIG. 2 is an enlarged front elevational view of the invention per se.
Figure 3:
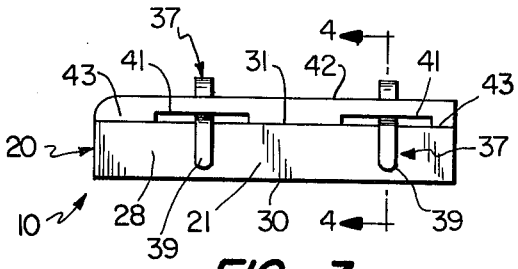
FIG. 3 is a top plan view thereof.
Figure 4:
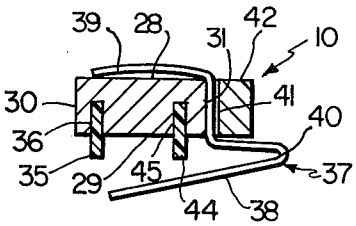
FIG. 4 is an enlarged sectional view taken along line 4—4 of FIG. 3.

With particular reference to FIG. 2, the capo 10 includes a generally C-shaped frame 20 having a pressure bar 21 and a backing element 22 which are integrally connected at one end by a connecting bar 23. The pressure bar 21 and backing element 22 are disposed outwardly from the connecting bar 23 in a generally parallel alignment.

In order to clampingly engage the capo about the neck and fingerboard of a stringed instrument, any conventional clamping mechanism may be used. In the type illustrated, a clamping arm or lever 24 is pivotally connected along the length of the connecting bar and such arm extends outwardly therefrom between the pressure bar 21 and backing element 22. As the back or underneath side of most necks are curved to conform to the curvature of a person's hand, the clamping lever is arcuately shaped to be in conformity therewith. Further, the clamping lever may be coated with a resilient material or padding along its concave surface so as to buffer the area of contact between the lever and the neck of the instrument.

When the capo is placed in use, the neck of the instrument passes between the pressure bar 21 and the clamping lever 24. In order to secure the capo in a desired position, the lever is forced toward the pressure bar and into engagement with the neck of the instrument by advancing an adjusting screw 25. The adjusting screw is threadedly carried by the backing element 22 and has an adjusting knob 26 adjacent the outer end thereof. The forward end of the screw is seated against the rear or convex surface of the clamping lever 24.

With reference to FIG. 2, the pressure bar 21 is shown as being slightly arcuately shaped having an upper outer surface 28 and a concave lower inner surface 29 disposed in a facing relationship to the concave surface of the clamping lever, and forward and rear walls 30 and 31, respectively. The shape of the pressure bar is such as to conform to the slightly arcuate shape of many conventional fingerboards. In this regard, it is noted that the pressure bar may be constructed relatively straight to accommodate instruments having generally planar or flat fingerboards.

In order to provide a contact medium to urge the strings against a selected fret and thereby alter the pitch of the string by changing its vibratory length, a narrow strip of resilient material or clamping pad 35 is provided to extend from and along the inner surface 29 of the pressure bar 21. The clamping pad is disposed in a groove 36 which is located adjacent the front wall 30 of the pressure bar and which extends generally the full length thereof. The clamping pad is secured in place by a close friction fit having a greater portion of its height maintained within the groove. Further, the pad may be glued or otherwise fixed within the groove 36.

The clamping pad is constructed in a generally narrow elongated manner having a rectangular cross-section with the width of the pad being of a lesser dimension than the height thereof. A resilient material is chosen for use which is sufficiently pliable to permit the material to conform around the strings and rest against the fret in use. This complete envelopment of each string at the fret insures accurate pitch and reduced undesirable "twang" or vibration. In this regard, it has been determined that a resilient thermoplastic material such as polyurethane or the like having a shore hardness on the A scale of between 35 to 95 durometer, with a shore hardness of approximately 65 A being preferred, would be the most suitable for use.

Since the pad 35 is of a generally narrow construction and is extended outwardly from a tightly engaged base, the material will be only slightly deflectable along the length of the strings. However, due to the type of material being used and narrow construction of the pad, a slight deflection of a portion of the pad adjacent to one string of the instrument created by the relative displacement of the string to the pad during tuning will not cause or create a deflection in the material adjacent any of the other strings.

In order to position the string clamping pad 35 in a desired relationship to a fret, the capo is provided with a pair of fret engaging stop members 37. Such stop members are preferably constructed of relatively thin spring metal or plastic and include a foot 38 and mounting portion 39. The foot is normally urged toward the fingerboard and away from the inner surface 29 of the pressure bar 21 by a generally U-shaped spring-like section 40. Although the stop members may be attached to the pressure bar 21 by several methods, it is preferred that the mounting be such as to allow each stop member to be movably adjusted or spaced along the length of the pressure bar to accommodate variations in string spacing. In the present embodiment, a pair of elongated slots 41 are provided adjacent to the rear wall 31 of the pressure bar by securely mounting a supplemental wall 42 along the length of the rear wall. The supplemental wall 42 has a plurality of spacers 43 which engage the rear wall 31 and space the supplemental wall 42 from the pressure bar. Alternatively, the slots 41 could extend through the main body of the pressure bar. The mounting portion of each stop member is inserted through the slot and bent over slightly to apply pressure to the top of the pressure bar. Thus, members are locked into place by a spring-like mounting which insures their normal position but may be adjusted within the slots by applying a slight downward pressure on the mounting portions overlying the pressure bar 21 and simultaneously sliding the members along the slots.

Figure 6:
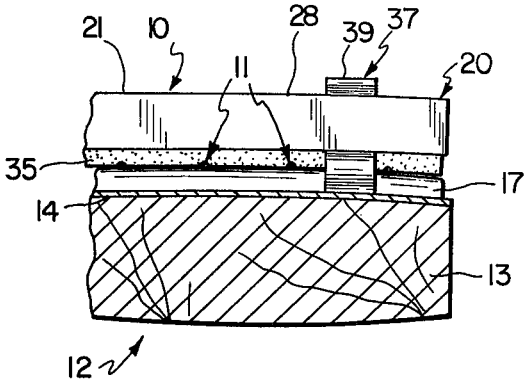
FIG. 6 is a sectional view taken along line 6—6 of FIG. 5.

Since the stop members may be moved along their respective slots 41 and thereafter secured in place, they may be selectively moved relative to one another so as to be appropriately spaced to extend between the strings of an instrument, as shown in FIG. 6, without interfering or abutting the strings and will remain so spaced until reset. Such spacing may be easily adjusted so that the capo can be used with instruments having differing string spacings.

Figure 5:
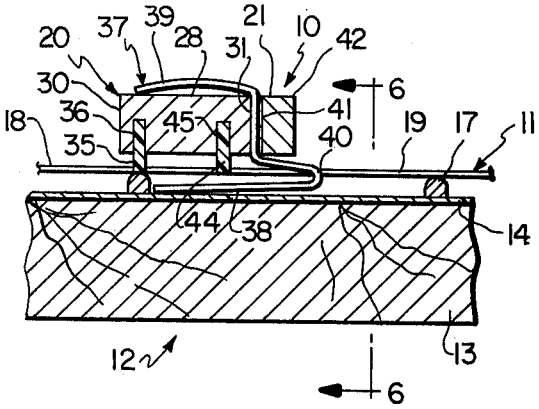
FIG. 5 is a fragmentary cross-sectional view of the invention illustrating its placement on a stringed instrument.

In order for the fret engaging stop members 37 to locate the clamping pad 35 in a desired position relative to a selected fret, the foot 38 thereof extends toward the front wall 30 of the pressure bar 21 and terminates at a point which is generally in alignment with the rear edge of the clamping pad 35. Therefore, as the capo is slid along the fingerboard, the stop members, which are being deflected downwardly against the fingerboard, will engage or abut a fret thereby preventing continued movement of the capo along the fingerboard. Further, due to the spaced relationship of the stop members 37 to the rear edge of the clamping pad 35, when the stop members contact a selected fret 17, the clamping pad is in a position overlying the fret, as shown in FIG. 5.

In order to prevent the non-playing portion 19 of the strings 11 from vibrating and thereby producing undesired tones when the capo is in use, an elongated relatively narrow damping pad or squeegee 44 is secured along the inner surface of the pressure bar. The damping pad 44 is preferably constructed of the same resilient material as the clamping pad 35 and is of the same general construction.

The damping pad 44 is securely mounted in a second groove 45 provided in the inner surface of the pressure bar. The groove 45 extends generally parallel to the clamping pad mounting groove 36 and is spaced therefrom toward the rear wall of the pressure bar.

As the damping pad 44 is constructed similarly to the clamping pad 35, it is relatively pliable along the line of the strings. Therefore, as one of the strings is tuned, the portion of the damping pad 44 which is in engagement with the string will give slightly without causing a deflection of the other portions of the pad which are in contact with the other strings. In this manner, the tuning of the strings is less likely to create a movement of the damping pad or the pressure bar which could alter the effective tension on the other strings.

In the operation of the device, when it is desired to alter the pitch of the strings of an instrument such as a guitar, ukulele, banjo, or the like, the capo of the present invention can be easily placed about the neck and over the strings and fingerboard of the instrument and thereafter securely clamped thereto to force all of the strings against a selected fret.

In practice, in order to place the capo along the neck of the instrument, the stop members 37 are initially spaced so as to be disposed between the strings, as shown in FIG. 6. Next, the adjusting screw 25 is rotated to permit the clamping bar 24 to be pivoted away from the pressure bar 21. The capo is then inserted around the neck with the pressure bar being disposed above the strings and the clamping bar positioned adjacent the back of the neck.

With the capo loosely in place on the neck, it may be easily moved along the fingerboard to a desired position adjacent a selected fret. The capo is subsequently pushed forward, toward the sounding body 15 until the foot 38 of each of the spring-like stop members 37 abuts such selected fret. With the stop members abutting the fret, the adjusting screw is rotated to close the clamping bar relative to the pressure bar. As the capo is tightened and due to the cooperative alignment of the tip of the feet 38 and the resilient clamping pad 35, the clamping pad will be brought into compressive engagement with the strings 11 forcing them downward against the fret, as shown in FIG. 5. Also, as the capo is tightened, the damping pad 44 will be brought into a compressive engagement with the non-playing portion 19 of the strings and thereby effectively dampen those portions of the strings from further vibrations.

Due to the resilient nature of the damping and clamping pads and their relatively narrow and elongated construction, the pads will not only substantially encompass the upper portion of the strings, but the pads will be sufficiently flexible or pliable along the length of the strings to permit tuning of the strings but will be rigid enough so that any adjustment of one string will not have an adverse effect on the other strings. Therefore, any movement of a portion of the pads in engagement with an adjusted string will not be translated to other portions of the pads.

It should be further noted that due to the positive stop and accurate alignment of the clamping pad relative to the frets, adjustment can be made in the placement of the capo in such a manner that a minimum of the user's effort and attention are required.

I claim:

1. An apparatus for selectively adjusting the pitch of a stringed instrument including a neck having a fingerboard with a plurality of frets spaced thereon over which the strings pass, comprising bar means extended over the strings and across the fingerboard, said bar means having upper and lower surfaces and front and rear walls, clamping means for operatively forcing said bar means toward the fingerboard, resilient string engaging means disposed along said lower surface of said bar means and adjacent said front wall, fret abutting stop means mounted on said bar means and extending downwardly therefrom, said stop means having a portion substantially in alignment with said string engaging means, whereby when said portion of said stop means abuts a selected fret, said string engaging means is in a position overlying the fret.

2. The invention of claim 1 in which said bar means includes an elongated groove along said lower surface thereof, said string engaging means being securely mounted within said groove and extending outwardly from said lower surface of said bar means.

3. The invention of claim 1 including a resilient string damping means disposed along said lower surface of said bar means and adjacent said rear wall thereof, said string damping means being fixedly mounted on said bar means and spaced from and independent of said string engaging means.

4. The invention of claim 3 in which said resilient string engaging means and said string damping means are constructed of resilient thermoplastic material having a shore hardness of approximately 35A to 95A durometer.

5. The invention of claim 1 in which said stop means includes first and second stop members, each of said stop members being movably mounted on said bar means so that said stop members may be adjusted to accommodate the strings of the instrument.

6. The invention of claim 5 in which said stop members are mounted in slots provided through said bar means.

7. The invention of claim 1 in which said stop means includes first and second spaced members, each of said members having a resilient portion, said fret abutting portions of each of said members being urged away from said lower surface of said bar means by said resilient portions.

8. An apparatus for selectively adjusting the pitch of a stringed instrument having a neck portion along one side of which is disposed a fingerboard with a plurality of frets spaced thereon over which the strings pass comprising bar means disposed over and across the fingerboard and over the strings, said bar means having upper and lower surfaces, clamping means for operatively forcing said bar means toward the fingerboard, at least one resilient string engaging means securely retained within said bar means and extending downwardly from said lower surface, said resilient string engaging means being relatively narrow and having a width dimension substantially less than the height dimension, said string engaging means being yieldable enough to permit tuning of a string when said bar means is securely clamped with said string engaging means in pressured contact forcing the strings against a fret and rigid enough to prevent distortion of a portion of said string engaging means adjacent one string from being translated along said engaging means to another portion thereof adjacent another string, and means carried by said bar means for engaging a selected fret to space said resilient string engaging means relative to the selected fret.

9. The invention of claim 8 in which said string engaging means is constructed of a polyurethane plastic having a shore hardness of approximately 35A to 95A durometer.

10. An apparatus for selectively adjusting the pitch of a stringed instrument having a sounding body, neck, head and a plurality of frets disposed along the neck comprising clamping means having pressure bar means disposed above the strings and cooperative clamping member disposed below the neck, said pressure bar means having upper, lower and front and back surfaces, first and second relatively flexible string contacting means, said first and second string contacting means being relatively narrow and of a length to extend across the strings of the instrument, means for rigidly mounting said first and second string contacting means in spaced relationship along said lower surface of said pressure bar means, said first string contacting means being disposed adjacent to said front surface of said pressure bar means, a pair of adjustably mounted stop means extending from said lower surface of said pressure bar means, said stop means having an outer portion for abutting a fret, said outer portion of said stop means extending forwardly toward said front surface of said pressure bar means and terminating at a point which is substantially in alignment with said first string contacting means, whereby when said apparatus is placed along the neck of an instrument with said stop means abutting a selected fret, said first string contacting means is in contact with the strings along the selected fret.

11. In a capo having string engaging means for use with a stringed instrument having a body with an elongated neck and a plurality of spaced frets, the improvement comprising stop means carried by said capo for engaging a selected fret and positioning said string engaging means in a selected position relative to a fret.

* * * * *